US005118315A

United States Patent [19]

Funami et al.

[11] Patent Number: 5,118,315

[45] Date of Patent: Jun. 2, 1992

[54] METHOD OF AND APPARATUS FOR CONTROLLING THE ANGLE OF TRIM OF MARINE PROPULSION UNIT

[75] Inventors: Yasuo Funami; Yoshimi Watanabe, both of Saitama, Japan

[73] Assignee: Kabushiki Kaisha Showa Seisakusho, Japan

[21] Appl. No.: 473,914

[22] Filed: Feb. 2, 1990

[30] Foreign Application Priority Data

Mar. 10, 1989 [JP] Japan ..... 1-59452

[51] Int. Cl.[5] ..... B63H 21/22

[52] U.S. Cl. ..... 440/1

[58] Field of Search ..... 440/1, 53, 61, 113, 440/900

[56] References Cited

U.S. PATENT DOCUMENTS 3,468,282 9/1969 Wintercorn ..... 440/1

4,813,896 3/1989 Koike et al. ..... 440/1

*Primary Examiner*—Jesus D. Sotelo

*Attorney, Agent, or Firm*—Howard L. Rose

[57] ABSTRACT

The angle of trim of a propulsion unit of a boat is controlled by actuating a tilt and trim unit based on an angle of the propulsion unit. If the angle of the hull of the boat with respect to the horizontal plane or the acceleration of the hull exceeds a predetermined value, the tilt and trim unit is actuated to reduce the angle of trim in overriding relation to a control mode for controlling the angle of trim based on the angle of the propulsion unit.

9 Claims, 3 Drawing Sheets

METHOD OF AND APPARATUS FOR CONTROLLING THE ANGLE OF TRIM OF MARINE PROPULSION UNIT

BACKGROUND OF THE INVENTION

1. Field of the Invention

The present invention relates to a method of and an apparatus for controlling the angle of trim of the propulsion unit of a ship such as a motorboat.

2. Description of the Relevant Art

FIGS. 5A and 5B show a small ship 100 such as a motorboat having a hull 101 and a propulsion unit 102 such as an outboard motor mounted on the stern of the hull 101. The propulsion unit 102 is angularly adjustable with respect to the hull 101 so that the angle $\theta$ of tilt of the propulsion unit 102 with respect to the horizontal central axis of the hull 101 is variable for producing propulsive forces efficiently. More specifically, a pair of laterally spaced transom brackets 103 is attached to the stern of the hull 101 such that the transom brackets 103 are symmetrically positioned with respect to a vertical plane which contains the longitudinal central axis of the hull 101. Between the transom brackets 103, there is pivotally coupled a swivel bracket (not shown) which is vertically and horizontally angularly movable, with the propulsion unit 102 mounted on the swivel bracket. The angle $\theta$ of tilt of the propulsion unit 101 is detected by a tilt angle sensor (not shown) disposed between the propulsion unit 102 and one of the transom brackets 103. A leveling sensor (not shown) for detecting the angle $\beta$ at which the propulsion unit 102 is slanted with respect to the horizontal plane is mounted on the propulsion unit 102 itself. The angle $\theta$ of tilt of the propulsion unit 102, the angle $\beta$ of the propulsion unit 102 from the horizontal plane, and the angle of trim can be varied by a tilt and trim unit 104 disposed between the transom brackets 103.

More specifically, the tilt and trim unit 104 is actuated by a control circuit (not shown) based on signals from the leveling sensor and the tilt angle sensor so that the propulsion unit 102 produces horizontal propulsive thrust at all times either when the motorboat 100 is at rest or planes as shown in FIG. 5A or immediately after the motorboat 100 is accelerated as shown in FIG. 5B.

Fuel consumption by the propulsion unit 102 is better while the motorboat 100 is planing. Right after the motorboat 100 is accelerated, the stem of the hull 101 is lifted off the water as shown in FIG. 5B. If the angle of trim is varied to produce horizontal propulsive thrust as described above when the stem is lifted as shown in FIG. 5B, then the stem is further lifted upwardly. As a result, the motorboat 100 cannot plane, does not give the boatsman a sufficiently wide front view for maneuvering, and suffers bad fuel economy.

The present invention has been made in an effort to effectively solve the above problems of the conventional method of controlling the angle of trim of a marine propulsion unit.

SUMMARY OF THE INVENTION

It is an object of the present invention to provide a method of and an apparatus for controlling the angle of trim of a small ship such as a motorboat or the like so that the ship can quickly be brought back to a planing condition from an accelerated condition, thereby giving the boatsman a good front view and increasing fuel economy.

According to the present invention, there is provided a method of controlling the angle of trim of a propulsion unit mounted on the stern of a boat by detecting an angle of the propulsion unit and supplying a drive circuit for a tilt and trim unit with a signal to increase or reduce the angle of trim based on the detected angle of the propulsion unit, characterized in that if an angle of a hull of the boat with respect to the horizontal plane or an acceleration of the hull exceeds a predetermined value, a signal to reduce the angle of trim is applied to the drive circuit for the tilt and trim unit in overriding relation to a control mode for controlling the angle of trim based on the angle of the propulsion unit.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1B:
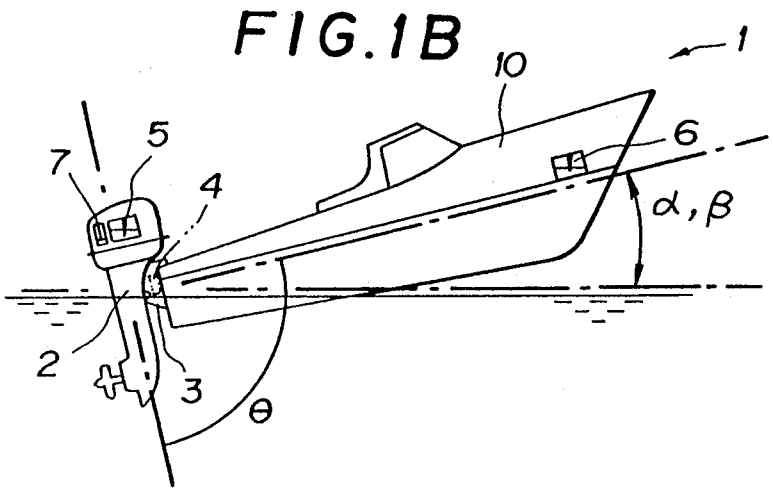
FIGS. 1A and 1B are schematic side elevational views of a motorboat having a propulsion unit with its angle of trim being controlled by a trim angle control method according to the present invention.
Figure 1A:
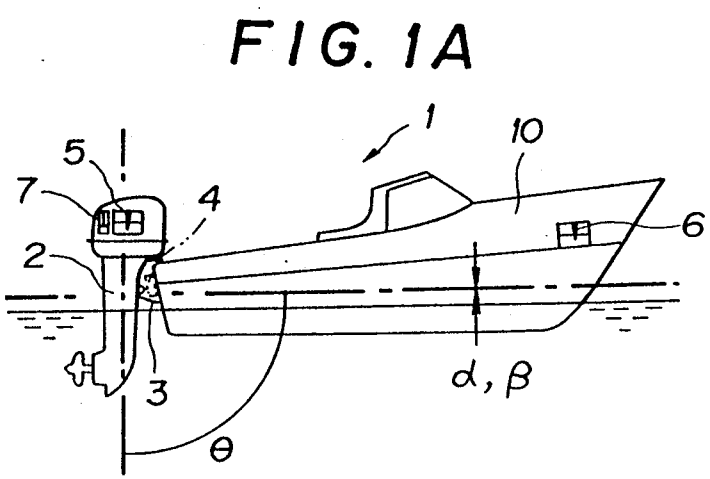
Figure 5B:
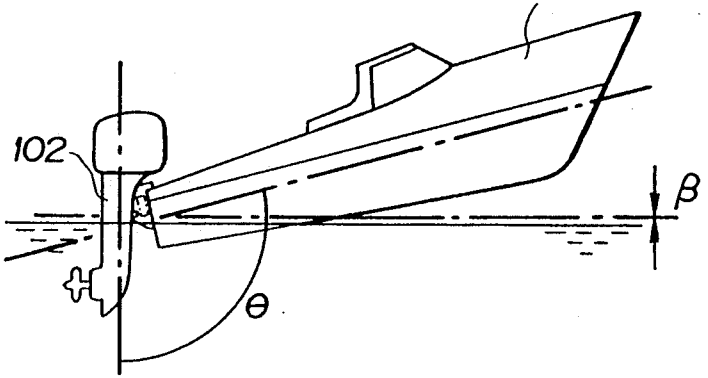
FIGS. 5A and 5B are schematic side elevational views of a motorboat having a propulsion unit with its angle of trim being controlled by a conventional trim angle control method.
Figure 5A:
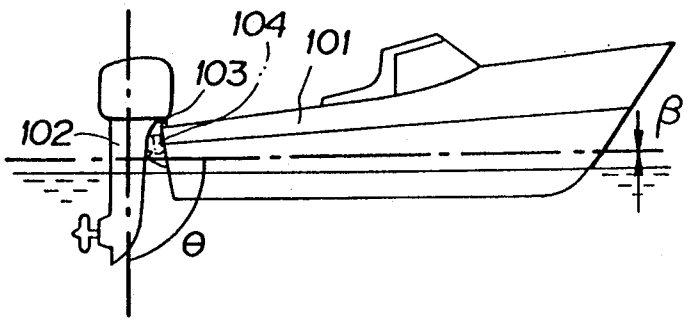

FIGS. 1A and 1B show a motorboat 1 having a propulsion unit 2 with the angle $\theta$ of tilt and the angle of trim controllable by a trim angle control method according to the present invention. FIG. 1A shows the motorboat 1 which is at rest or planing, and FIG. 1B shows the motorboat 1 right after it is accelerated. The motorboat 1 has a hull 10 with the propulsion unit 2 such as an outboard motor mounted on the stern of the hull 10. A pair of laterally spaced transom brackets 3 is attached to the stern of the hull 10 such that the transom brackets 3 are symmetrically positioned with respect to a vertical plane which contains the longitudinal central axis of the hull 10. Between the transom brackets 3, there is pivotally coupled a swivel bracket (not shown) which is vertically and horizontally angularly movable, with the propulsion unit 2 mounted on the swivel bracket. A leveling sensor 5 for detecting the angle $\beta$ at which the propulsion unit 2 is slanted with respect to the horizontal plane is mounted on top of the propulsion unit 2 itself. In FIG. 1A, the angle $\beta$ is 0 (zero). The angle $\alpha$ at which the hull 10 is slanted with respect to the horizontal plane is detected by another leveling sensor 6 which is mounted in the stem of the hull 10. An acceleration sensor 7 for detecting the acceleration $\gamma$ of the motorboat 1 is mounted on the propulsion unit 2.

The angle $\theta$ of tilt and the angle of trim of the propulsion unit 2 are controlled by a tilt and trim unit 4 which is disposed between the transom brackets 3.

Figure 2:
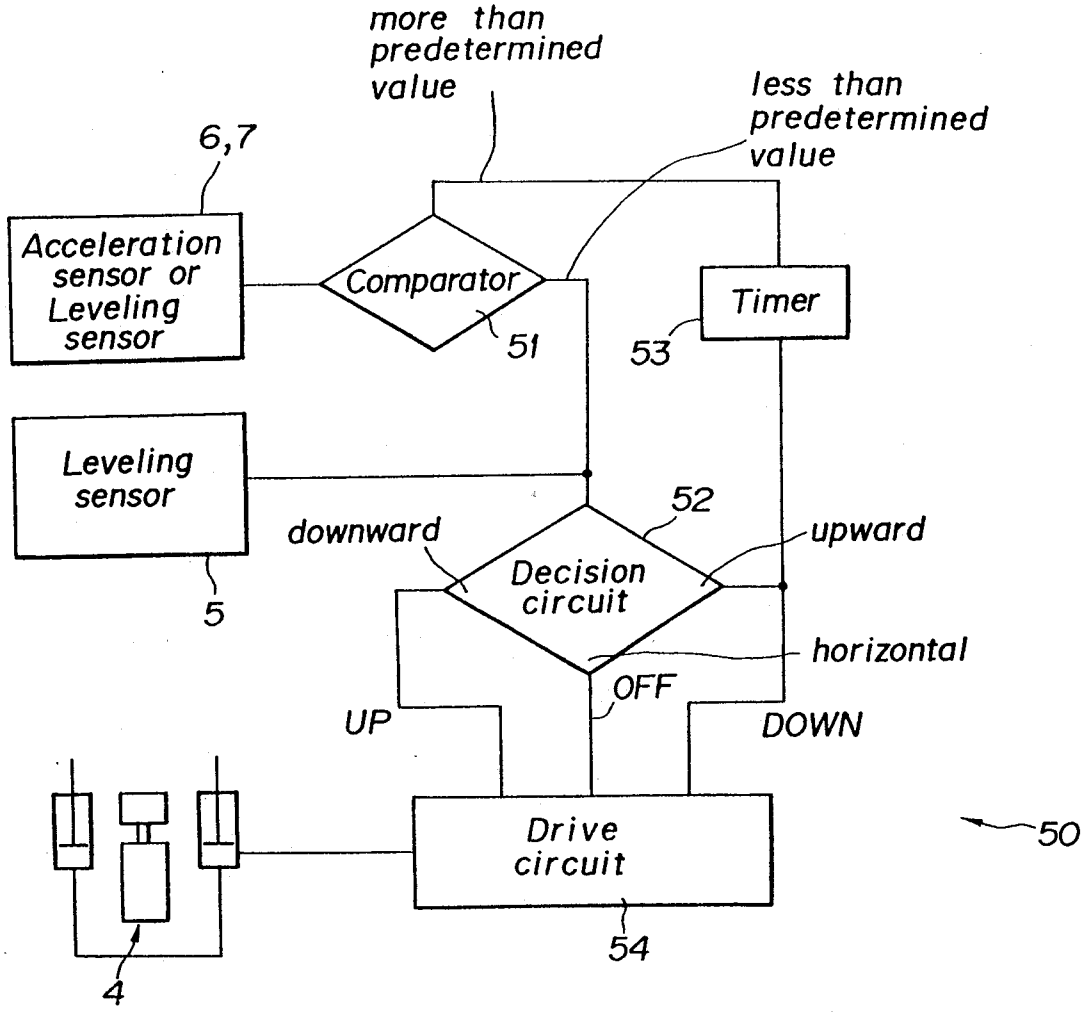
FIG. 2 is a block diagram of a trim angle control circuit on the motorboat shown in FIG. 1A.

The motorboat 1 has a control circuit 50 as shown in FIG. 2. A detected signal from the leveling sensor 6 or the acceleration sensor 7 is supplied to a comparator 51. The comparator 51 compares the angle $\alpha$ at which the hull 10 is slanted with a predetermined reference value $\alpha r$, or compares the acceleration $\gamma$ of the motorboat 1 with a predetermined reference value $\gamma r$.

If the detected angle $\alpha$ exceeds the reference value $\alpha r$ or the detected acceleration $\gamma$ exceeds the reference value $\gamma r$, then a tilt-down signal is sent from a timer 53 to a drive circuit 54 for a predetermined period of time tr, and the drive circuit 54 actuates the tilt and trim unit 4 to trim down the propulsion unit 2, i.e., to move the propulsion unit 2 in a direction to reduce the angle of trim thereof.

If the detected angle $\alpha$ is smaller than the reference value $\alpha r$ or the detected acceleration $\gamma$ is smaller than the reference value $\gamma r$, then the drive circuit 54 is controlled by a decision circuit 52. More specifically, the decision circuit 52 is supplied with a detected signal from the leveling sensor 5 on the propulsion unit 2. Based on the angle $\beta$ of the propulsion unit 2, which is represented by the detected signal from the leveling sensor 5, the decision circuit 52 controls the drive circuit 54 to actuate the tilt and trim unit 4 such that the propulsive thrust produced by the propulsion unit 2 is exerted horizontally. More specifically, if the propulsive thrust is directed upwardly, then the tilt and trim unit 4 is actuated to reduce the angle $\beta$ of the propulsion unit 2 with respect to the horizontal plane. If the propulsive thrust is directed downwardly, then the tilt and trim unit 4 is actuated to increase the angle $\beta$ of the propulsion unit 2 with respect to the horizontal plane. If the propulsive thrust is directed horizontally, then the tilt and trim unit 4 is not actuated.

While the motorboat 1 is sailing, the hull 10 and the propulsion unit 2 vibrate at all times. The angles $\alpha$, $\beta$ based on the output signals from the leveling sensors 5, 6 are determined by averaging several successive measured values obtained at intervals of 0.2 second, for example.

The above operation is summarized as follows: When the angle $\alpha$ of the hull 10 is greater than the predetermined value $\alpha r$ or the acceleration $\gamma$ is greater than the predetermined value $\gamma r$ while the motorboat 1 is being accelerated, the control circuit 50 actuates the tilt and trim unit 4 in order to reduce the angle of trim of the propulsion unit 2 for the period of time tr. Otherwise, the control circuit 50 actuates the tilt and trim unit 5 in order to exert the propulsive thrust of the propulsion unit 2 horizontally. More specifically, when the detected values $\alpha$, $\gamma$ exceeds the respective reference values $\alpha r$, $\gamma r$, the control circuit 50 overrides the normal controlling operation and trims down the propulsion unit 2. As a result, when the motorboat 1 is accelerated from the rest or planing condition shown in FIG. 1A and its stem is lifted as shown in FIG. 1B, the propulsion unit 2 is trimmed down, i.e., angularly moved to reduce the angle of trim. Therefore, any horizontal component of the propulsive thrust produced by the propulsion unit 2 is reduced, returning he motorboat 1 to the planing condition as quickly as possible.

Either one of the leveling sensor 6 on the hull 10 and the acceleration sensor 7 on the propulsion unit 2 may be dispensed with.

With the method of controlling the angle of trim according to the present invention, even if the stem of the motorboat 1 is temporarily lifted when it is accelerated, the stem of the motorboat 1 is prevented from being further lifted, and the motorboat 1 returns to the planing condition as quickly as possible. Therefore, the boatsman is given a wide front view, and the fuel economy of the motorboat 1 is increased. Any sensor for detecting the angle of trim may be omitted.

Figure 3:
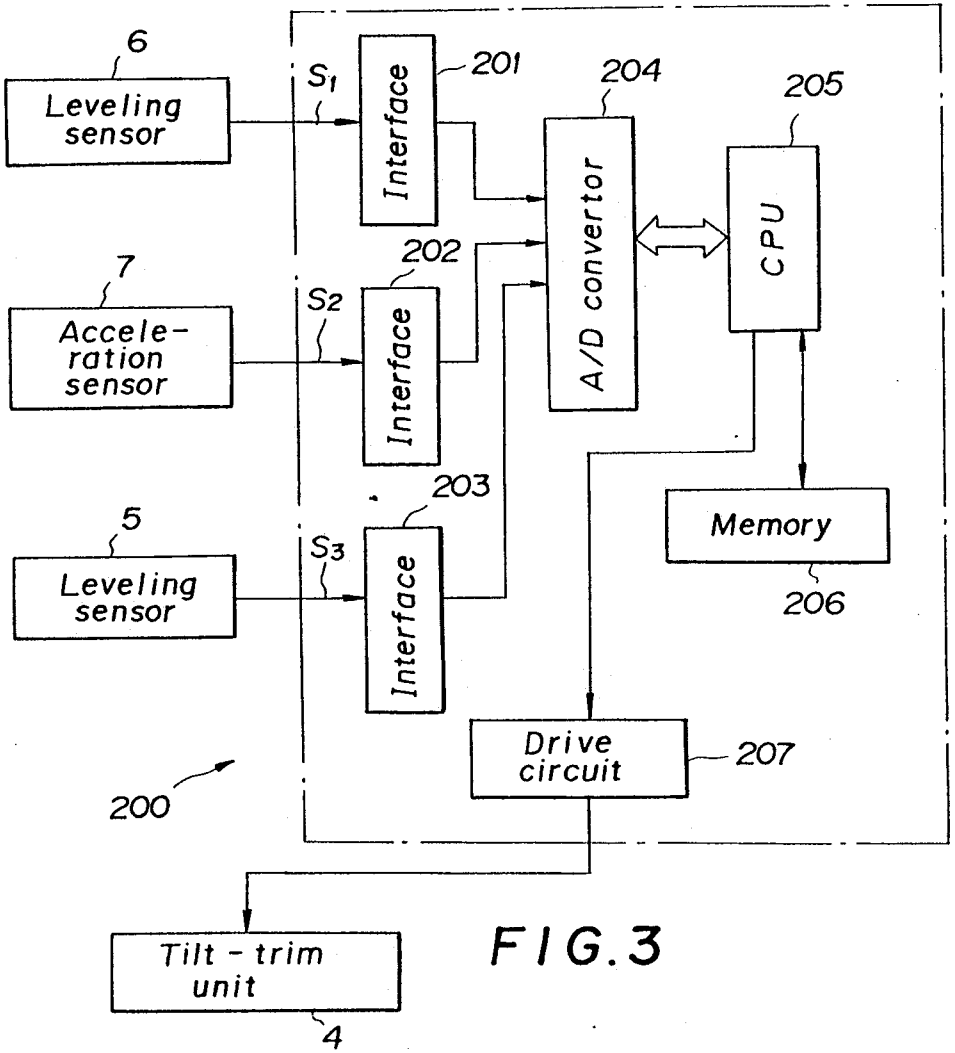
FIG. 3 is a block diagram of a modified trim angle control circuit.

FIG. 3 shows a modified trim angle control circuit. Those parts shown in FIG. 3 which are identical to those shown in FIG. 2 are denoted by identical reference numerals.

The tilt and trim unit 4 is controllably actuated by a control circuit 200. The control circuit 200 is supplied with detected signals S1, S2, S3 from the hull leveling sensor 6, the acceleration sensor 7, and the propulsion unit leveling sensor 5. These detected signals S1, S2, S3 are applied through respective interfaces 201, 202, 203 and an A/D converter 204 to a central processing unit (CPU) 205. The control circuit 200 also has a memory 206 which comprise a random access memory (RAM) and a read-only memory (ROM) that stores a program. According to the program stored in the ROM, the CPU 205 executes the processing sequence 250 shown in FIG. 4 and enables a drive circuit 207 to actuate the tilt and trim unit 4.

Figure 4:
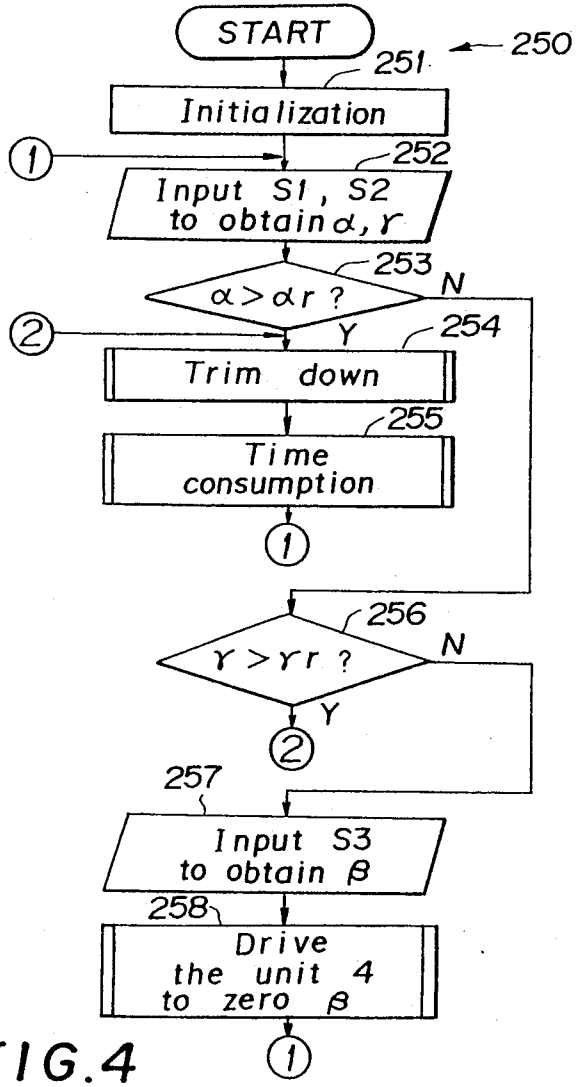
FIG. 4 is a flowchart of a control sequence executed by a CPU in the trim angle control circuit shown in FIG. 3.

As shown in FIG. 4, when a power supply (not shown) of the control circuit 200 is turned on, the interfaces 201, 202, 203 and various data stored in the RAM are initialized in a step 251.

Then, the detected signals S1, S2 from the leveling sensor 6 and the acceleration sensor 7 are applied to the CPU 205 which calculates an angle $\alpha$ at which the hull 10 is slanted and an acceleration $\gamma$ of the motorboat 1 according to the applied signals S1, S2 in a step 252. Actually, the detected signals S1, S2 are applied to the CPU 205 several times at the intervals of 0.2 second, for example, and the CPU 205 employs the average of the applied values.

The CPU 205 then determines whether the detected angle $\alpha$ is greater than a predetermined reference value $\alpha r$ or not in a step 253. If the angle $\alpha$ is greater than the reference value $\alpha r$, then control proceeds to a step 254.

In the step 254, the CPU 205 controls the drive circuit 207 to actuate the tilt and trim unit 4 to reduce the angle of trim of the propulsion unit 2. The processing in the step 254 is continued until a preset time tr elapses in a step 255. After elapse of the time tr in the step 255, the actuation of the tilt and trim unit 4 through the drive circuit 207 is stopped. Then, control goes from the step 255 to the step 252.

If it is found in the step 253 that the detected angle $\alpha$ is smaller than the reference value $\alpha r$, then control goes to a step 256.

In the step 256, the CPU 205 determines whether the detected acceleration $\gamma$ is greater than a predetermined reference value $\gamma r$. If the acceleration $\gamma$ is greater than the reference value $\gamma r$, the control goes to the step 254 in which the angle of trim is reduced. If the acceleration $\gamma$ is smaller than the reference value $\gamma r$, then control goes to a step 257.

In the step 257, the CPU 205 calculates an angle $\beta$ at which the propulsion unit 2 is slanted with respect to the horizontal plane, according to the detected signal S3 from the leveling sensor 5 on the propulsion unit 2. Actually, the detected signal S3 is applied to the CPU 205 several times at the interval of 0.2 second, for example, and the CPU 205 employs the average of the applied values.

Then, the CPU 205 controls the drive circuit 207 to actuate the tilt and trim unit 4 to eliminate the detected angle $\beta$ of the propulsion unit 2 in a step 258. In the step 258, therefore, the propulsive thrust produced by the propulsion unit 2 is directed horizontally.

After the step 258, control goes back to the step 252.

The control circuit 200 shown in FIG. 3 offers the same advantages as those of the control circuit 50 shown in FIG. 2

Although there have been described what are at present considered to be the preferred embodiments of the present invention, it will be understood that the invention may be embodied in other specific forms without departing from the essential characteristics thereof. The present embodiments are therefore to be considered in all aspects as illustrative, and not restrictive. The scope of the invention is indicated by the appended claims rather than by the foregoing description.

We claim:

1. A method of automatically controlling the angle of trim of a propulsion unit mounted on the stern of a boat by employing a sensor to detect the angle of the propulsion unit with respect to the horizontal plane and supplying a drive circuit for a tilt and trim unit with a signal to increase or reduce the angle of trim based on the detected angle of the propulsion unit, characterized in that a signal to reduce the angle of trim is automatically produced and applied to the drive circuits for the tilt and trim unit in overriding relation to a control mode for controlling the angle of trim based on the angle of the propulsion unit is produced under three different circumstances: (1) the angle of the hull with respect to the horizontal plane, (2) the acceleration of the hull with respect to the horizontal plane, and (3) both the angle and acceleration of the hull exceed predetermined values.

2. A method according to claim 1 wherein the signal is applied for a period determined by a timing function.

3. A method according to claim 1 wherein the signal is applied in measured intervals until the desired trim is achieved.

4. A method of automatically controlling the angle of trim of a propulsion unit of a motorboat, comprising the steps of:

determining when the motorboat is vertically accelerated;

reducing the angle of trim of the propulsion unit when the motorboat is accelerated; and substantially eliminating an angle at which the propulsion unit is slanted with respect to the horizontal plane in order to direct the propulsive thrust of the propulsion unit substantially horizontally, when the motorboat is not accelerated.

5. A method according to claim 4, wherein said step of determining whether the motorboat is accelerated or not comprises the steps of:

detecting at least one of an angle at which a hull of the motorboat is slanted with respect to the horizontal plane and an acceleration of the motorboat; and determining whether at least one of the detected angle and the detected acceleration exceeds a predetermined reference value or not.

6. An apparatus for controlling the angle of trim of a propulsion unit of a motorboat, comprising:

first detecting means for detecting an accelerated condition of the motorboat;

second detecting means for detecting an angle at which the propulsion unit is slanted with respect to the horizontal plane; and control means responsive to detected signals from said first and second detecting means for angularly moving the propulsion unit to reduce the angle of trim thereof if the motorboat is accelerated, and to substantially eliminate said angle at which the propulsion unit is slanted in order to direct the propulsive thrust of the propulsion unit substantially horizontally if the motorboat is not accelerated.

7. An apparatus according to claim 6, wherein said first detecting means comprises at least one of a sensor for detecting an angle at which the hull of the motorboat is slanted with respect to the horizontal plane, and a sensor for detecting an acceleration of the motorboat.

8. An apparatus according to claim 6, further comprising a timing device for controlling timing of signals to said control means.

9. An apparatus according to claim 8 wherein said timing device applies detected signals to said control means in uniform increments until the desired trim is achieved.

* * * * *